US012234690B2

(12) United States Patent
He et al.

(10) Patent No.: US 12,234,690 B2
(45) Date of Patent: Feb. 25, 2025

(54) EXPERIMENTAL APPARATUS FOR ROCK-BREAKING THROUGH VIBRATION IMPACT

(71) Applicant: China University of Petroleum-Beijing, Beijing (CN)

(72) Inventors: Wenhao He, Beijing (CN); Chao Xiong, Beijing (CN); Ran Ji, Beijing (CN); Huaizhong Shi, Beijing (CN); Zhongwei Huang, Beijing (CN); Zhenliang Chen, Beijing (CN); Zongjie Mu, Beijing (CN); Xinkang Fu, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 15 days.

(21) Appl. No.: 18/197,026

(22) Filed: May 12, 2023

(65) Prior Publication Data

US 2024/0352795 A1 Oct. 24, 2024

(30) Foreign Application Priority Data

Apr. 19, 2023 (CN) ..... 202310423233.1

(51) Int. Cl.

| | |
|---|---|
| ***E21B 1/14*** | (2006.01) |
| ***E21B 1/26*** | (2006.01) |
| ***E21B 21/01*** | (2006.01) |
| ***E21B 47/06*** | (2012.01) |

(52) U.S. Cl.

CPC ..... *E21B 1/14* (2020.05); *E21B 1/26* (2020.05); *E21B 21/013* (2020.05); *E21B 47/06* (2013.01)

(58) Field of Classification Search

CPC .... E21B 1/14; E21B 1/00; E21B 1/12; G01N 33/24

See application file for complete search history.

(56) References Cited

U.S. PATENT DOCUMENTS

2021/0222541 A1* 7/2021 Tapson ..... E21B 47/024

* cited by examiner

*Primary Examiner* — Catherine Loikith

(74) *Attorney, Agent, or Firm* — Weaver Austin Villeneuve & Sampson LLP

(57) ABSTRACT

An experimental apparatus for rock-breaking through vibration impact, including a confining pressure loading assembly, a drill bit, a drill rod, a drilling fluid circulation assembly, a rotary impact assembly and an axial impact assembly. The confining pressure loading assembly is configured to apply pressures to a core sample located in a core cavity in three directions perpendicular to each other. The drill bit is capable of inserting into the core cavity to drill the core sample. The drilling fluid circulation assembly includes a drilling fluid inlet, a drilling fluid outlet and a mud pump connected therebetween. The rotary impact assembly includes a hydraulic rotary motor and a hydraulic swing motor connected to the drill rod, respectively. The axial impact assembly includes a first hydraulic cylinder, and a servo linear actuator connected to the first hydraulic cylinder and the drill rod.

10 Claims, 3 Drawing Sheets

EXPERIMENTAL APPARATUS FOR ROCK-BREAKING THROUGH VIBRATION IMPACT

CROSS-REFERENCE TO RELATED APPLICATIONS

This application claims priority to Chinese Patent Application No. 202310423233.1, filed on Apr. 19, 2023, which is hereby incorporated by reference in its entirety.

TECHNICAL FIELD

The present disclosure relates to the technical field of drilling, and particularly to an experimental apparatus for rock-breaking through vibration impact.

BACKGROUND

In the field of oil and gas engineering, it has become an inevitable choice to exploit deep conventional oil and gas reservoirs and unconventional oil and gas reservoirs to improve the oil and gas recovery. However, the exploitation of such oil and gas reservoirs is difficult, especially the drilling faces unprecedented technical challenges, mainly manifested in the fact that, with the increase of the drilling depth, the hardness of the reservoir rocks is increasingly rising, and the difficulty of rock breaking also increases. Relevant researches show that the percussion drilling technology has become an efficient method for breaking deep hard rocks, and devices such as a torsional impactor and an axial hydraulic impactor have become the focus of research on deep well drilling.

However, there are few experimental researches on rock breaking by high-frequency vibration impact, resulting in failure to provide theoretical guidance for on-site deep well drilling.

SUMMARY

The embodiments of the present disclosure provide an experimental apparatus for rock-breaking through vibration impact, so as to solve the problems pointed out in the background section or other similar problems.

An embodiment of the present disclosure provides an experimental apparatus for rock-breaking through vibration impact, including a confining pressure loading assembly, a drill bit, a drill rod, a drilling fluid circulation assembly, a rotary impact assembly, and an axial impact assembly. The confining pressure loading assembly includes a core cavity for accommodating a core sample and a liquid outlet being in communication with the core cavity. The confining pressure loading assembly is configured to apply pressures to the core sample located in the core cavity in three directions perpendicular to each other. The drill bit is capable of inserting into the core cavity to drill the core sample. The drill rod is connected to the drill bit. The drilling fluid circulation assembly includes a drilling fluid inlet, a drilling fluid outlet and a mud pump connected therebetween. The drilling fluid outlet is in fluid communication with the drill bit through the drill rod. The drilling fluid inlet is in fluid communication with the liquid outlet. The mud pump, the drilling fluid outlet, the drill rod, the drill bit, the core cavity, the liquid outlet, the drilling fluid inlet and the mud pump are in fluid communication in sequence to form a mud circulation channel. The rotary impact assembly includes a hydraulic rotary motor and a hydraulic swing motor connected to the drill rod, respectively. The hydraulic rotary motor is capable of applying a torque in a first direction to the drill rod. The hydraulic swing motor is capable of alternately applying an instantaneous torque in the first direction and an instantaneous torque in a second direction to the drill rod. The first direction and the second direction are clockwise or counterclockwise and opposite to each other. The axial impact assembly includes a first hydraulic cylinder, and a servo linear actuator connected to a piston rod of the first hydraulic cylinder and the drill rod. The first hydraulic cylinder is capable of applying a thrusting force in a third direction to the drill rod. The servo linear actuator is capable of alternately applying a thrusting force in the third direction and a tensile force in a fourth direction to the drill rod. The third direction is opposite to the fourth direction.

In some embodiments, the experimental apparatus further includes a temperature control assembly including a heating element for heating the core sample in the core cavity, a temperature sensor for detecting a temperature of the core sample, and a controller electrically connected to the temperature sensor and the heating element. The heating element and the temperature sensor are disposed on the confining pressure loading assembly.

In some embodiments, the confining pressure loading assembly includes a plurality of pressing plates being jointly enclosed to form the core cavity, and at least three second hydraulic cylinders for applying pressures to at least three pressing plates perpendicular to each other in three directions perpendicular to each other, respectively.

In some embodiments, the drilling fluid circulation assembly further includes a mud tank connected between the drilling fluid inlet and the drilling fluid outlet for accommodating drilling fluid, and a desander connected between the drilling fluid inlet and the drilling fluid outlet for removing solid impurities in the drilling fluid.

In some embodiments, the experimental apparatus further includes a fixed bracket, a movable bracket, a third hydraulic cylinder, and a locking device. The movable bracket is disposed on the fixed bracket and movably in an axial direction. The first hydraulic cylinder and the hydraulic rotary motor are mounted on the movable bracket. The third hydraulic cylinder is connected to the fixed bracket and the movable bracket and is capable of driving the movable bracket to ascend and descend in the axial direction. The locking device is connected to the movable bracket and is capable of releasably locking the movable bracket with the fixed bracket.

In some embodiments, the fixed bracket includes a plurality of supporting posts, and each of the supporting posts is disposed in the axial direction. The movable bracket includes a plurality of supporting platforms disposed at intervals in the axial direction and connected in sequence. Each of the supporting posts passes through the plurality of supporting platforms. At least one of the supporting platforms is connected to at least one of the supporting posts through the locking device.

In some embodiments, the fixed bracket includes a base, the plurality of supporting posts are fixed on the base, the base is provided with a plurality of guide rails disposed at intervals in parallel, and the confining pressure loading assembly is provided with tracks fitted with the guide rails.

In some embodiments, the experimental apparatus further includes a data collection assembly. The data collection assembly includes a displacement sensor disposed in the first hydraulic cylinder, a magnetostrictive displacement sensor disposed on the servo linear actuator, a pressure sensor connected to the servo linear actuator, a torsion angle measuring instrument connected to the drill rod and located between the hydraulic rotary motor and the hydraulic swing motor, a torque sensor for measuring a torque of the drill rod, and a rotational speed sensor for measuring a rotational speed of the drill rod.

In some embodiments, the experimental apparatus further includes a servo controller and a constant pressure servo pumping station. The servo controller is configured to receive measurement data collected by the data collection assembly and a user instruction, and send a control signal according to the measurement data and the user instruction. The constant pressure servo pumping station is configured to receive the control signal, and control the first hydraulic cylinder, the servo linear actuator and the hydraulic swing motor according to the control signal. The constant pressure servo pumping station is electrically connected to the hydraulic rotary motor to control the rotation of the hydraulic rotary motor.

In some embodiments, the experimental apparatus further includes a terminal device in communicative connection with the confining pressure loading assembly, the drilling fluid circulation assembly, the data collection assembly, and the servo controller.

The embodiments of the present disclosure can simulate the formation pressure during actual drilling by providing the confining pressure loading assembly, simulate the circulation conditions of the drilling fluid during actual drilling by providing the drilling fluid circulation assembly, simulate the formation temperature during actual drilling by providing the temperature control assembly, and simulate the high-frequency vibration impact applied by the drill bit during actual drilling by providing the rotary impact assembly and the axial impact assembly, so as to facilitate the researches of the influence of vibration impact on the breakage of the rock sample and provide guidance for the theoretical researches.

BRIEF DESCRIPTION OF THE DRAWINGS

For a clearer illustration of technical features in the embodiments of the present disclosure or the prior art, a brief description of the drawings for the embodiments or the prior art will be given below. Obviously, the drawings described below involve only some embodiments of this disclosure. For those of ordinary skill in the art, other drawings can be derived from these drawings without any inventive efforts. In the drawings.

DETAILED DESCRIPTION

For a better understanding of the technical features of the present disclosure, a clear and complete description of the embodiments of the present disclosure will be set forth with reference to the drawings. Obviously, the described embodiments are only a part, rather than all, of the embodiments of the present disclosure. All other embodiments derived by persons skilled in the art from the embodiments of the present disclosure without making inventive efforts shall fall within the scope of the present disclosure.

In the embodiments of the present disclosure, the terms 'first', 'second', etc. are used to distinguish different elements from each other based on appellations, but do not indicate the spatial arrangement, temporal order, or the like of these elements, and these elements should not be limited by these terms. The term 'and/or' includes any of one or more of associated listed terms and all combinations thereof. The terms 'include', 'comprise', 'have', etc. refer to the presence of the stated features, elements, components, or assemblies, but do not exclude the presence or addition of one or more other features, elements, components, or assemblies.

In the embodiments of the present disclosure, the singular forms 'a', 'the' or the like may include the plural form, and should be broadly understood as 'a type of' or 'a category of' and not limited to the meaning of 'one'. In addition, the term 'said' should be understood as including both singular and plural forms, unless the context clearly indicates otherwise. Furthermore, the term 'according to' should be understood as 'at least partially according to . . . ' and the term 'based on' should be understood as 'at least partially based on . . . ', unless the context clearly indicates otherwise. Moreover, the term "a plurality of" means two or more, unless otherwise specified.

The implementations of the embodiments of the present disclosure will now be described with reference to the drawings.

Figure 1:
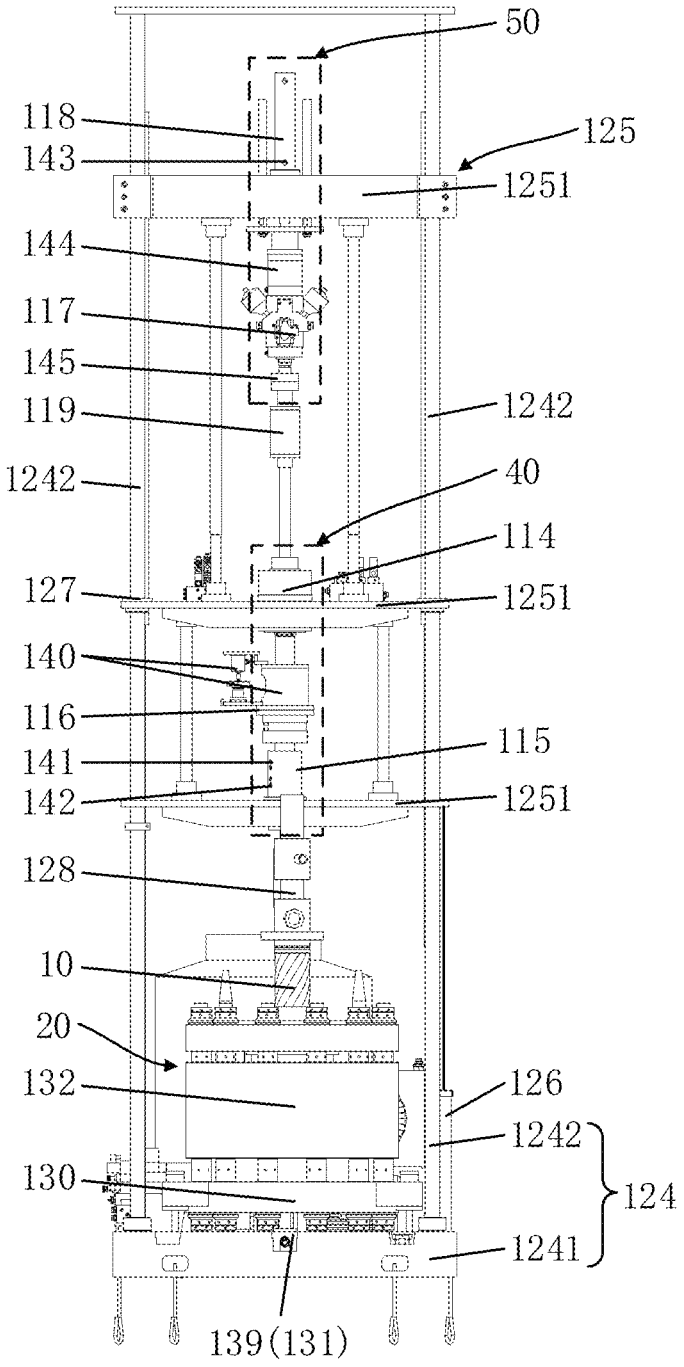
FIG. 1 is a schematic structural diagram of an experimental apparatus for rock-breaking through vibration impact according to an embodiment of the present disclosure.

As illustrated in FIG. 1, an embodiment of the present disclosure provides an experimental apparatus for rock-breaking by vibration impact, which includes a drill bit 10, a confining pressure loading assembly 20, a drilling fluid circulation assembly 30, a rotary impact assembly 40, an axial impact assembly 50 and a data collection assembly.

As illustrated in FIG. 1, the drill bit 10 is capable of drilling a core sample to simulate a drilling process of a drill bit during an on-site drilling. The drill bit 10 may be, for example, a Polycrystalline Diamond Compact (PDC) drill bit, which is suitable for drilling rock formations with high hardness. As illustrated in FIG. 1, the drill bit 10 is connected to a drill rod 128.

Figure 2:
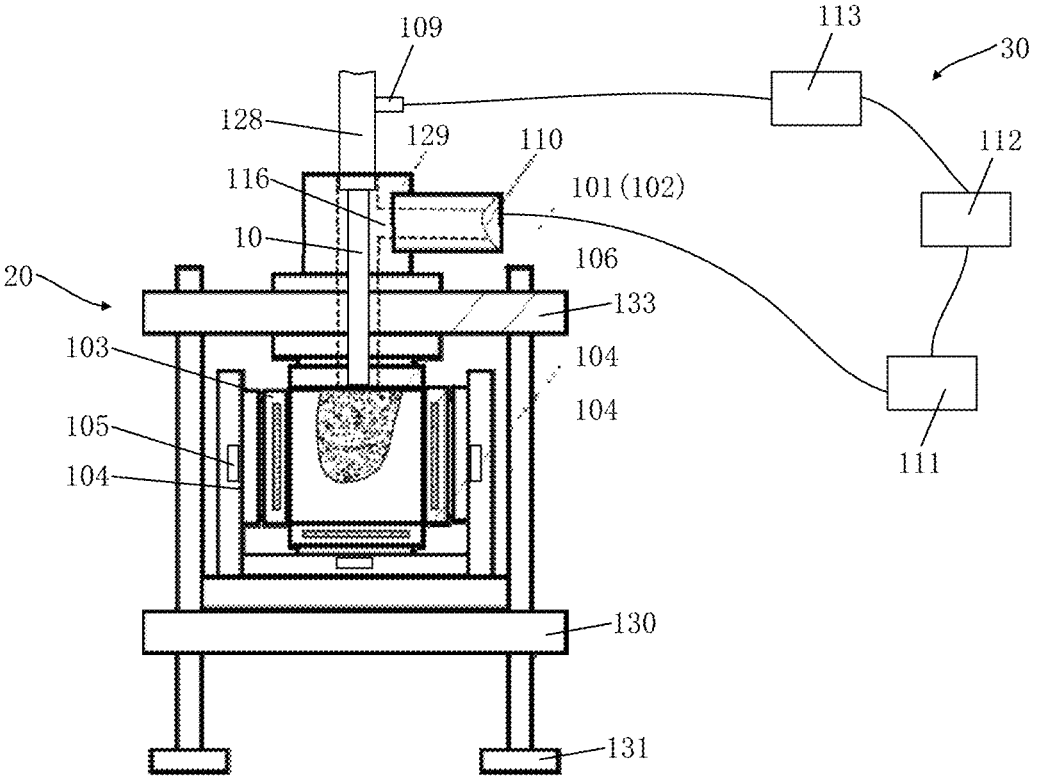
FIG. 2 is a schematic structural diagram of a confining pressure loading assembly and a drilling fluid circulation assembly according to an embodiment of the present disclosure.

In some embodiments, as illustrated in FIGS. 1 and 2, the confining pressure loading assembly 20 is capable of applying a confining pressure to a core sample 101 to simulate a formation confining pressure. Specifically, as illustrated in FIG. 2, the confining pressure loading assembly 20 includes a core cavity 102 and a liquid outlet 116 being in communication with the core cavity 102. The core cavity 102 is used for accommodating the core sample 101, and the liquid outlet 116 is used for being connected to the drilling fluid circulation assembly 30. The confining pressure loading assembly 20 is configured to apply pressures to the core sample 101 located in the core cavity 102 in three directions perpendicular to each other. In other words, the confining pressure loading assembly 20 can apply pressures to the core sample 101 in an X direction, a Y direction and a Z direction which are perpendicular to each other. For example, the confining pressure loading assembly 20 may be, for example, a true triaxial core holder.

Optionally, as illustrated in FIG. 2, the confining pressure loading assembly 20 includes a plurality of pressing plates 103 and at least three hydraulic cylinders (i.e., second hydraulic cylinders). The pressing plates 103 are jointly enclosed to form the core cavity 102. The at least three hydraulic cylinders 104 are used to apply pressures to at least three pressing plates 103 perpendicular to each other in three directions perpendicular to each other.

Illustratively, as illustrated in FIG. 2, the core sample 101 and the core cavity 102 are square, and there are six pressing plates 103 which are jointly enclosed to form the square core cavity 102. The pressing plate 103 at the top of the core sample 101 (called the top pressing plate 103) is provided with a via-hole, through which the core cavity 102 is being in communication with the outside and the drill bit 10 can pass to drill the core sample 102 located in the core cavity 102.

In one example, there may be five hydraulic cylinders 104 respectively connected to five pressing plates 103 except the top pressing plate 103, at the exterior of the core cavity 102, so as to drive the five pressing plates 103 to simultaneously apply pressures to the core sample 101 in three directions perpendicular to each other, thereby simulating the formation confining pressure.

In another example, there may be three hydraulic cylinders 104 respectively connected to three pressing plates 103 perpendicular to each other to drive the three pressing plates 103 to simultaneously apply pressures to the core sample 101 in three directions perpendicular to each other, so as to simulate the formation confining pressure.

Optionally, as illustrated in FIG. 2, the confining pressure loading assembly 20 further includes a bottom plate 130, a barrel 132 and an upper cover 133. The barrel 132 is fixed on the bottom plate 130. The barrel 132 and the bottom plate 130 jointly define an internal space with an open top. The pressing plates 103 and the hydraulic cylinder 104 are disposed in the internal space. The upper cover 133 is disposed at the top of the internal space and detachably connected to the barrel 132 to allow for the pressing plates 103 and the hydraulic cylinder 104 to be placed into or taken out of the internal space.

Optionally, as illustrated in FIG. 2, the confining pressure loading assembly 20 further includes a sealing joint 129 which may be in sealed connection with the upper cover 133. The drill rod 128 passes through the sealing joint 129. The liquid outlet 116 is disposed at the sealing joint 129.

Optionally, as illustrated in FIG. 2, the confining pressure loading assembly 20 further includes a pressure sensor 105 for detecting a pressure applied on the core sample 101. For example, there may be three pressure sensors 105 for detecting the pressures in three directions perpendicular to each other, respectively. For example, the pressure sensors 105 may be disposed on the hydraulic cylinders 104, and the hydraulic pressures of the hydraulic cylinders detected by the pressure sensor 105 may be considered as the pressures applied on the core sample 101.

Figure 3:
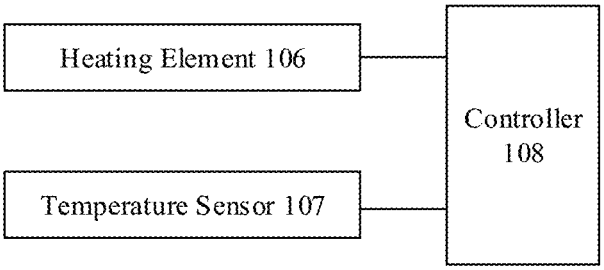
FIG. 3 is a schematic block diagram of a temperature control assembly according to an embodiment of the present disclosure.

In some embodiments, as illustrated in FIGS. 2 and 3, the experimental apparatus of the present disclosure further includes a temperature control assembly for heating the core sample 101 to simulate the formation temperature. The temperature control assembly includes a heating element 106 for heating the core sample 101 located in the core cavity 102, a temperature sensor 107 for detecting the temperature of the core sample 101, and a controller 108 electrically connected to the temperature sensor 107 and the heating element 106 which are disposed on the confining pressure loading assembly 20.

Illustratively, the heating element 106 may be a heating tube mounted on the pressing plate 103. For example, the pressing plate 103 is provided with a mounting groove in which the heating tube is disposed. Each of the pressing plates 103 may be provided with a plurality of heating tubes disposed at intervals to realize uniform and rapid heating. Each of the pressing plates 103 may be provided with a temperature sensor 107 for detecting the temperature of the pressing plate 103, and the temperature of the pressing plate 103 detected by the temperature sensor 107 may be considered as the temperature of the core sample 101.

Illustratively, the controller 108 may be a PID temperature control meter, which may receive temperature data from the temperature sensor 107 and control the heating element 106 to heat the core sample 101 based on the temperature data and a temperature set by a user, so that the core sample 101 is heated to the temperature set by the user.

In some embodiments, as illustrated in FIG. 2, the drilling fluid circulation assembly 30 is capable of simulating a drilling fluid circulation during an on-site drilling. The drilling fluid circulation assembly 30 includes a drilling fluid outlet 109, a drilling fluid inlet 110, and a mud pump 111 connected therebetween. Being driven by the mud pump 111, drilling fluid flows into the drilling fluid circulation assembly 30 via the drilling fluid inlet 110 and then flows out of the drilling fluid outlet 109. The drilling fluid outlet 109 is in fluid communication with the drill bit 10 through the drill rod 128, and the drilling fluid inlet 110 is in communication with the liquid outlet 116. The mud pump 111, the drilling fluid outlet 109, the drill rod 128, the drill bit 10, the core cavity 102, the liquid outlet 116, the drilling fluid inlet 110 and the mud pump 111 are in fluid communication in sequence to form a mud circulation channel. Therefore, the drilling fluid flowing out via the drilling fluid outlet 109 flows into the drill bit 10, and then is sprayed from a nozzle of the drill bit 10, flows back upwardly carrying rock debris broken by the drill bit 10, then flows out of the confining pressure loading assembly 20 via the liquid outlet 116 and flows into the drilling fluid circulation assembly 30 via the drilling fluid inlet 110, and then flows out of the drilling fluid circulation assembly 30 via the drilling fluid outlet 109 and enters the drill bit 10 under the drive of the mud pump 111 for a next circulation flow.

Optionally, as illustrated in FIG. 2, the drilling fluid circulation assembly 30 further includes a mud tank 112 and a desander 113 which are connected between the drilling fluid inlet 110 and the drilling fluid outlet 109. The mud tank 112 is used for accommodating drilling fluid, and the desander 113 is used for removing solid impurities such as gravel and rock debris in the drilling fluid.

Illustratively, in a flowing direction of the drilling fluid, the desander 113, the mud tank 112 and the mud pump 111 are connected in sequence. Therefore, the drilling fluid entering the drilling fluid circulation assembly 30 via the drilling fluid inlet 110 is purified by the desander 113 and then enters the mud tank 112. Being driven by the mud pump 111, the drilling fluid in the mud tank 112 flows out of the drilling fluid circulation assembly 30 via the drilling fluid outlet 109 and enters the drill bit 10.

The desander 113 may be, for example, a cyclone desander, which separates solid impurities from the drilling fluid on the principle of hydraulic cyclone separation. Alternatively, the desander 113 may be a vibrating screen.

The mud pump 111 may be, for example, a submersible pump.

In some embodiments, as illustrated in FIG. 1, the rotary impact assembly 40 is capable of applying a rock-breaking torque and a circumferential impact load to the drill bit 10 to drive the drill bit 10 to break the core sample 101.

The rotary impact assembly 40 includes a hydraulic rotary motor 114 connected to the drill rod 128 and a hydraulic swing motor 115 connected to the drill rod 128. The rock-breaking torque and the circumferential impact load applied by the rotary impact assembly 40 can be transferred to the drill bit 10 through the drill rod 128, and a Weight on Bit (WOB) and an axial impact load applied by the axial impact assembly 50 are transferred to the drill bit 10 through the drill rod 128, so as to drive the drill bit 10 to drill the core sample.

Specifically, the hydraulic rotary motor 114 is capable of applying a torque in a first direction (i.e., a rock-breaking torque) to the drill rod 128, so as to drive the drill rod 128 and the drill bit 10 to rotate in a first direction, which is clockwise or counterclockwise.

Specifically, the hydraulic swing motor 115 is configured to alternately apply a torque (i.e., an impact torque) in the first direction and a torque (i.e., an impact torque) in a second direction to the drill rod 128. The second direction is clockwise or counterclockwise and is opposite to the first direction.

When the hydraulic swing motor 115 applies the impact torque in the first direction to the drill rod 128, the rotation of the drill bit 10 in the first direction will be accelerated. When the hydraulic swing motor 115 applies the impact torque in the second direction to the drill rod 128, the rotation of the drill bit 10 in the first direction will be decelerated. The time interval between alternately applying the torque in the first direction and the torque in the second direction by the hydraulic swing motor 115 is short, and the time duration for which the hydraulic swing motor 115 applies the torque in the first direction and the time duration for which the hydraulic swing motor 115 applies the second direction are also short, thereby driving the drill bit 10 to apply an instantaneous circumferential impact to the core sample 101.

The alternating frequency at which the hydraulic swing motor 115 alternately applies the torque in the first direction and the torque in the second direction, and the time durations for which the hydraulic swing motor 115 applies the torque in the first direction and the torque in the second direction may be set according to actual needs.

The hydraulic swing motor 115 may be connected to a pumping station, which provides an energy source to the hydraulic swing motor 115 by supplying oil. The hydraulic swing motor 115 is a hydraulic actuator with an output shaft that can swing reciprocally. The hydraulic swing motor 115 may be a vane swing motor or a piston swing motor. The working principle of the vane swing motor is that the vanes of the motor are driven by pressure oil to drive the output shaft to swing reciprocally. The working principle of the piston swing motor is that the piston of the motor is driven by pressure oil to move linearly to drive the output shaft to swing. The hydraulic swing motor 115 may be controlled by an electro-hydraulic servo valve. Upon receipt of a control instruction from a control system, the electro-hydraulic servo valve controls the hydraulic swing motor 115 to operate by controlling the flowrate and the direction of the hydraulic oil.

In this embodiment, the hydraulic swing motor 115 cooperates with the hydraulic rotary motor 114 to accelerate and decelerate the drill rod 128 at a certain frequency on the basis of the hydraulic rotary motor 114 driving the drill rod 128 to rotate, so as to achieve a dynamic and varying impact of the circumferential torque, thereby obtaining the circumferential impact force and impact frequency required by the experiment.

In this embodiment, the hydraulic rotary motor and the hydraulic swing motor are available from the prior art, and the specific structures thereof will not be described in detail.

Optionally, the drill rod 128 is provided with a torsion angle measuring instrument 140, which is located between the hydraulic rotary motor 114 and the hydraulic swing motor 115 and connected to the drill rod 128. When the hydraulic rotary motor 114 drives the drill rod 128 to rotate, the torsion angle measuring instrument 140 rotates synchronously with the drill rod 128. When the hydraulic swing motor 115 applies an instantaneous impact torque to the drill rod 128, the instantaneous impact torque causes an instantaneous tiny circumferential impact displacement of the drill rod 128, or in other words, the instantaneous impact torque causes an instantaneous tiny impact rotation angle of the drill rod 128, and the value of the impact rotation angle can be measured by the torsion angle measuring instrument 140.

Optionally, the experimental apparatus of the present disclosure further includes a torque sensor 141 for measuring a torque of the drill rod 128 and a rotational speed sensor 142 for measuring a rotational speed of the drill rod 128. The torque of the drill rod 128 is the sum of the torques applied to the drill rod 128 by the hydraulic rotary motor 114 and the hydraulic swing motor 115.

Illustratively, the torque sensor 141 is a non-contact torque sensor, and the rotational speed sensor 142 is a non-contact rotational speed sensor, so that the torque sensor 141 and the rotational speed sensor 142 can be mounted at positions aligned with the drill rod 128 without rotating with the drill rod 128. For example, the torque sensor 141 and the rotational speed sensor 142 are mounted on a housing of the hydraulic swing motor 115.

Optionally, as illustrated in FIG. 1, the hydraulic rotary motor 114 and the hydraulic swing motor 115 are supported by a platform, and actuating parts of the hydraulic rotary motor 114 and the hydraulic swing motor 115 are fixedly connected to the drill rod 128 to apply a rotation torque and an impact torque to the drill rod 128.

In some embodiments, the axial impact assembly 50 is capable of applying a WOB and an axial impact load to the drill bit 10 to drive the drill bit 10 to break the core sample 101.

The axial impact assembly 50 includes a hydraulic cylinder 118 (i.e., a first hydraulic cylinder), a servo linear actuator 117 and a connector 119. The servo linear actuator 117 is connected to the drill rod 128, and a piston rod of the hydraulic cylinder 118 is connected to the servo linear actuator 117.

The hydraulic cylinder 118 is capable of applying a thrusting force to the drill rod 128 in a third direction. The third direction is towards the core sample 101 and parallel to an axial direction of the drill rod 128. Since the hydraulic cylinder 118 is connected to the drill rod 128 through the servo linear actuator 117, the thrusting force generated by the hydraulic cylinder 118 is applied to the drill rod 128 through the servo linear actuator 117. The thrusting force applied by the hydraulic cylinder 118 provides the WOB to the drill rod 128 and the drill bit 10, and drives the drill rod 128 and the drill bit 10 to move towards the core sample 101.

The servo linear actuator 117 is capable of alternately applying a thrusting force in the third direction and a tensile force in a fourth direction to the drill rod 128. The fourth direction is opposite to the third direction and parallel to the axial direction of the drill rod 128.

When the servo linear actuator 117 applies the thrusting force in the third direction to the drill rod 128, the axial drilling of the drill bit 10 in the third direction will be accelerated. When the servo linear actuator 117 applies the tensile force in the fourth direction to the drill rod 128, the axial drilling of the drill rod 128 in the third direction will be decelerated. The time interval between alternately applying the thrusting force in the third direction and the tensile force in the fourth direction by the servo linear actuator 117 is short, and the time duration for which the servo linear actuator 117 applies the thrusting force in the third direction and the time duration for which the servo linear actuator 117 applies the tensile force in the fourth direction are also short, thereby driving the drill bit 10 to apply an instantaneous axial impact to the core sample 101.

The servo linear actuator 117 can apply controllable thrusting force and tensile force to the drill rod 128, and the axial impact load applied to the drill rod 128 by the servo linear actuator 117 is controlled by controlling the amplitude of the servo linear actuator 117, thereby controlling the axial impact force of the drill bit 10 on the core sample 101.

The servo linear actuator 117 may be connected to a pumping station, which provides an energy source to the servo linear actuator 117 by supplying oil. The servo linear actuator 117 may be controlled by the electro-hydraulic servo valve. Upon receipt of a control instruction from a control system, the electro-hydraulic servo valve controls the servo linear actuator 117 to operate by controlling the flowrate and the direction of the pressure oil, so that the servo linear actuator 117 can generate linear and varying reciprocating force, thereby obtaining the axial impact force and impact frequency required by the experiment.

In this embodiment, the servo linear actuator is available from the prior art, and the specific structure thereof will not be described in detail.

Optionally, the hydraulic cylinder 118 is provided with a displacement sensor 143 for measuring the displacement of the piston rod of the hydraulic cylinder 118.

Optionally, the servo linear actuator 117 is provided with a magnetostrictive displacement sensor 144 for measuring the tiny axial displacement of the servo linear actuator 117 caused by the axial impact of the servo linear actuator 117.

In this embodiment, the servo linear actuator 117 is connected to the drill rod 128 through the connector 119. The connector 119 may be an end bearing, which can transfer the axial forces applied by the servo linear actuator 117 and the hydraulic cylinder 118 to the drill rod 128, without transferring the torque applied to the drill rod 128 by the hydraulic rotary motor 114 to the servo linear actuator 117 and the hydraulic cylinder 118, thereby reducing the circumferential friction exerted on the drill rod and avoiding the inaccuracy of the measured torque or the deviation of the experimental data.

Optionally, a pressure sensor 145 is connected between the servo linear actuator 117 and the connector 119 to measure the WOB.

Figure 4:
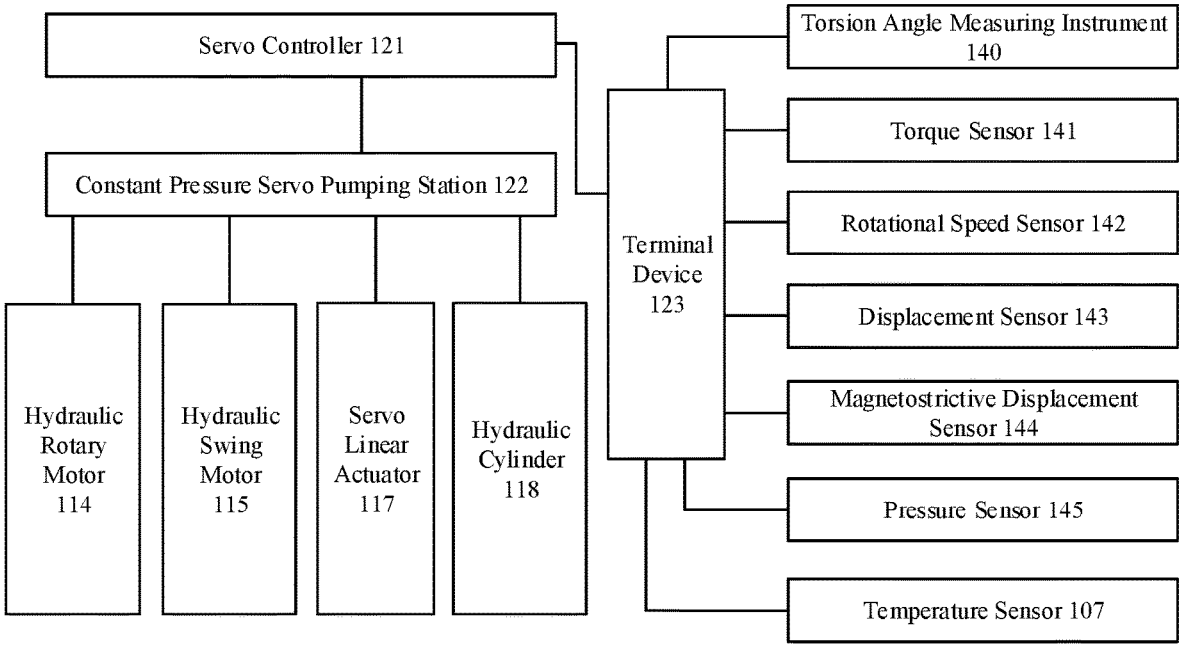
FIG. 4 is a schematic block diagram of a control system according to an embodiment of the present disclosure.

In some embodiments, as illustrated in FIG. 4, the experimental apparatus of the present disclosure further includes a servo controller 121 and a constant pressure servo pumping station 122. The servo controller 121 is configured to receive measurement data collected by the torsion angle measuring instrument 140, the torque sensor 141, the rotational speed sensor 142, the displacement sensor 143, the magnetostrictive displacement sensor 144 and the pressure sensor 145, and a user instruction, and configured to send a control signal according to the measurement data and the user instruction. The user instruction may be received from a computer or any other terminal. The constant pressure servo pumping station 122 is configured to receive the control signal and control the hydraulic swing motor 115, the hydraulic cylinder 118 and the servo linear actuator 117 according to the control signal. The constant pressure servo pumping station 122 is electrically connected to the hydraulic rotary motor 114 to control the rotation of the hydraulic rotary motor 114. The constant pressure servo pumping station 122 is electrically connected to the hydraulic cylinder 104 to control the action thereof.

In some embodiments, as illustrated in FIG. 4, the experimental apparatus of the present disclosure further includes a terminal device 123, which is in communicative connection with the confining pressure loading assembly 20, the drilling fluid circulation assembly 30, the data collection assembly and the servo controller 121. The terminal device 123 can receive and process the data sent by the confining pressure loading assembly 20, the drilling fluid circulation assembly 30 and the data collection assembly, and can send a user instruction to the servo controller 121. For example, the terminal device 123 is a computer.

Specifically, as illustrated in FIG. 4, the terminal device 123 is in communicative connection with the pressure sensor 105 of the confining pressure loading assembly 20, the temperature sensor 107 of the temperature control assembly, the mud pump 111 of the drilling fluid circulation assembly 30, and the data collection assembly.

Optionally, the measurement data collected by the torsion angle measuring instrument 140, the torque sensor 141, the rotational speed sensor 142, the displacement sensor 143, the magnetostrictive displacement sensor 144, and the pressure sensor 145 may be sent to the servo controller 121 directly or through the terminal device 123.

In some embodiments, as illustrated in FIG. 1, the experimental apparatus of the present disclosure further includes a fixed bracket 124, a movable bracket, a hydraulic cylinder 126 (i.e., a third hydraulic cylinder) and a locking device 127. The movable bracket is disposed on the fixed bracket 124 and movable in the axial direction. The hydraulic cylinder 118, the hydraulic rotary motor 114, and the hydraulic swing motor 115 are mounted on the movable bracket, so as to be supported by the movable bracket.

As illustrated in FIG. 1, the hydraulic cylinder 126 is connected to the fixed bracket 124 and the movable bracket 125, respectively, for driving the movable bracket 125 to ascend and descend in the axial direction, so as to adjust the height of the movable bracket 125, thereby adjusting the height of the drill bit 10. For example, by decreasing the height of the drill bit 10, the drill bit 10 inserts into the core cavity 102 to drill the core sample 101, and by increasing the height of the drill bit 10, the drill bit 10 moves out of the core cavity 102, so that the core sample 101 in the core cavity 102 can be taken out or replaced.

Specifically, as illustrated in FIG. 1, the hydraulic cylinder 126 is disposed in the axial direction, with one end connected to the fixed bracket 124 and the other end connected to the movable bracket 125. The hydraulic cylinder 126 drives the movable bracket 125 to ascend and descend by extending or shortening in the axial direction. There may be two hydraulic cylinders 126 opposite to each other and disposed at an interval to drive the movable bracket 125 to ascend and descend steadily. The constant pressure servo pumping station 122 is electrically connected to the hydraulic cylinder 126 to control the action thereof.

As illustrated in FIG. 1, the locking device 127 is connected to the movable bracket 125 for releasably locking the movable bracket 125 with the fixed bracket 124. For example, after the movable bracket 125 is adjusted to a preset height, the movable bracket 125 is locked with the fixed bracket 124 through the locking device 127, so as to carry out subsequent experimental operations. When it is necessary to adjust the height of the movable bracket 125, the locking device 127 unlocks (releases) the locking of the movable bracket, so that the hydraulic cylinder 126 drives the movable bracket 125 to ascend and descend until the movable bracket 125 reaches another preset height.

For example, the locking device 127 is a locking hydraulic cylinder, which locks the movable bracket 125 by means of hydraulic locking, so as to ensure that the movable bracket 125 will not move or crawl during the experiment, and achieve stable and reliable locking. The constant pressure servo pumping station 122 is electrically connected to the locking hydraulic cylinder to control the action thereof.

In some embodiments, as illustrated in FIG. 1, the fixed bracket 124 includes a base 1241 and a plurality of supporting posts 1242 fixed on the base 1241. Each of the supporting posts 1242 is disposed in the axial direction. The movable bracket 125 includes a plurality of supporting platforms 1251 disposed at intervals in the axial direction and connected in sequence for supporting the hydraulic cylinder 118, the hydraulic rotary motor 114, and the hydraulic swing motor 115, respectively. Each of the supporting posts 1242 passes through the plurality of supporting platforms 1251. Therefore, being driven by the hydraulic cylinder 126, the plurality of supporting platforms 1251 are guided by the supporting posts 1242 to ascend and descend in the axial direction. At least one of the supporting platforms 1251 is connected to at least one of the supporting posts 1242 through the locking device 127, so that the locking device 127 can lock the supporting platforms 1251 with the supporting post 1242.

For example, as illustrated in FIG. 1, there are three supporting platforms 1251 disposed at intervals from top to bottom. The hydraulic cylinder 118 is supported by the uppermost supporting platform 1251, the hydraulic rotary motor 114 is supported by the middle supporting platform 1251, and the hydraulic swing motor 115 is supported by the lowermost supporting platform 1251.

For example, there are four locking devices 127 and four supporting posts 1242. The four supporting posts 1242 are arranged as a rectangle, and the four locking devices 127 are disposed at the four corners of the middle supporting platform 1251, respectively, so as to lock the supporting platform 1251 with the four supporting posts 1242, thereby realizing stable and reliable locking.

Optionally, as illustrated in FIG. 1, the top surface of the base 1241 of the fixed bracket 124 is provided with a plurality of guide rails 139 disposed in parallel at intervals. A bottom surface of the bottom plate 130 of the confining pressure loading assembly 20 is provided with tracks 131 fitted with the guide rails 139, so that the confining pressure loading assembly 20 can be slidably fitted with the base 1241, thus facilitating moving the confining pressure loading assembly 20 onto or out of the base 1241, and facilitating the mounting or removing of the core sample 101.

In one example, the guide rail 139 is an elongated groove, and the track 131 is a bump that can be fitted with the groove.

In another example, the guide rail 139 is an elongated bump, and the track 131 is a groove that can be fitted with the bump.

Optionally, both the base 1241 and the bottom plate 130 are provided with a plurality of positioning holes. Therefore, after the confining pressure loading assembly 20 is moved onto the base 1241, bolts are mounted in the positioning holes to fix the base 1241 and the bottom plate 130, so as to avoid the deviation of the confining pressure loading assembly 20 during the experiment.

Described above is merely exemplary embodiments of the present disclosure, and is not meant to limit the present disclosure. Various modifications and variations may be made to the present disclosure by those skilled in the art. Any modifications, alternations, improvements, etc., made by those skilled in the art without departing from the concepts and principles of this disclosure shall fall within the scope of the claims.

What is claimed is:

1. An experimental apparatus for rock-breaking through vibration impact, the experimental apparatus comprising:

a confining pressure loading assembly comprising a core cavity for accommodating a core sample of a rock and a liquid outlet being in communication with the core cavity, the confining pressure loading assembly being configured to apply pressures to the core sample located in the core cavity in three directions perpendicular to each other;

a drill bit for inserting into the core cavity to drill the core sample;

a drill rod connected to the drill bit;

a drilling fluid circulation assembly, comprising a drilling fluid inlet, a drilling fluid outlet and a mud pump connected therebetween, wherein the drilling fluid outlet is in fluid communication with the drill bit through the drill rod, the drilling fluid inlet is in fluid communication with the liquid outlet, and the mud pump, the drilling fluid outlet, the drill rod, the drill bit, the core cavity, the liquid outlet, the drilling fluid inlet and the mud pump are in fluid communication in sequence to form a mud circulation channel;

a rotary impact assembly, comprising a hydraulic rotary motor and a hydraulic swing motor connected to the drill rod, respectively, wherein the hydraulic rotary motor is capable of applying a torque in a first direction to the drill rod, the hydraulic swing motor is capable of alternately applying an instantaneous torque in the first direction and an instantaneous torque in a second direction to the drill rod, and the first direction and the second direction are clockwise or counterclockwise and opposite to each other; and an axial impact assembly, comprising a first hydraulic cylinder and a servo linear actuator connected to a piston rod of the first hydraulic cylinder and to the drill rod, wherein the first hydraulic cylinder is capable of applying a thrusting force in a third direction to the drill rod, the servo linear actuator is capable of alternately applying a thrusting force in the third direction and a tensile force in a fourth direction to the drill rod, and the third direction is opposite to the fourth direction.

2. The experimental apparatus according to claim 1, further comprising:

a temperature control assembly, comprising a heating element for heating the core sample in the core cavity, a temperature sensor for detecting a temperature of the core sample, and a controller electrically connected to the temperature sensor and the heating element, wherein the heating element and the temperature sensor are disposed on the confining pressure loading assembly.

3. The experimental apparatus according to claim 1, wherein the confining pressure loading assembly comprises:

a plurality of pressing plates being jointly enclosed to form the core cavity; and at least three second hydraulic cylinders for applying pressures to at least three pressing plates perpendicular to each other in three directions perpendicular to each other, respectively.

4. The experimental apparatus according to claim 1, wherein the drilling fluid circulation assembly further comprises:

a mud tank connected between the drilling fluid inlet and the drilling fluid outlet for accommodating drilling fluid; and a desander connected between the drilling fluid inlet and the drilling fluid outlet for removing solid impurities in the drilling fluid.

5. The experimental apparatus according to claim 1, further comprising:

a fixed bracket;

a movable bracket disposed on the fixed bracket and movably in an axial direction, the first hydraulic cylinder and the hydraulic rotary motor being mounted on the movable bracket;

a third hydraulic cylinder connected to the fixed bracket and the movable bracket and being capable of driving the movable bracket to ascend and descend in the axial direction; and a locking device connected to the movable bracket and being capable of releasably locking the movable bracket with the fixed bracket.

6. The experimental apparatus according to claim 5, wherein, the fixed bracket comprises a plurality of supporting posts, and each of the supporting posts is disposed in the axial direction; and the movable bracket comprises a plurality of supporting platforms disposed at intervals in the axial direction and connected in sequence, each of the supporting posts passes through the plurality of supporting platforms, and at least one of the supporting platforms is connected to at least one of the supporting posts through the locking device.

7. The experimental apparatus according to claim 6, wherein, the fixed bracket comprises a base, the plurality of supporting posts are fixed on the base, the base is provided with a plurality of guide rails disposed at intervals in parallel, and the confining pressure loading assembly is provided with tracks fitted with the guide rails.

8. The experimental apparatus according to claim 1, further comprising:

a data collection assembly, comprising a displacement sensor disposed in the first hydraulic cylinder, a magnetostrictive displacement sensor disposed on the servo linear actuator, a pressure sensor connected to the servo linear actuator, a torsion angle measuring instrument connected to the drill rod and located between the hydraulic rotary motor and the hydraulic swing motor, a torque sensor for measuring a torque of the drill rod, and a rotational speed sensor for measuring a rotational speed of the drill rod.

9. The experimental apparatus according to claim 8, further comprising:

a servo controller configured to receive measurement data collected by the data collection assembly and a user instruction, and send a control signal according to the measurement data and the user instruction; and a constant pressure servo pumping station configured to receive the control signal, and control the first hydraulic cylinder, the servo linear actuator and the hydraulic swing motor according to the control signal, the constant pressure servo pumping station being electrically connected to the hydraulic rotary motor to control the rotation of the hydraulic rotary motor.

10. The experimental apparatus according to claim 9, further comprising:

a terminal device in communicative connection with the confining pressure loading assembly, the drilling fluid circulation assembly, the data collection assembly and the servo controller.

* * * * *